US005221297A

United States Patent [19]

Childress et al.

[11] Patent Number: 5,221,297

[45] Date of Patent: Jun. 22, 1993

[54] TRAVELING SPRAY ASSEMBLY AND METHOD FOR WASHING OF ELECTROSTATIC PRECIPITATOR COLLECTOR PLATES

[75] Inventors: Gerald J. Childress, Carroll; Jon M. Kaliszak, Columbus, both of Ohio

[73] Assignee: United McGill Corporation, Groveport, Ohio

[21] Appl. No.: 853,060

[22] Filed: Mar. 18, 1992

[51] Int. Cl.[5] ..... B03C 3/78

[52] U.S. Cl. ..... 55/13; 55/118; 55/120; 239/750

[58] Field of Search ..... 55/12, 13, 118, 117, 55/108, 120; 239/750, 751

[56] References Cited

U.S. PATENT DOCUMENTS

| | | | |
|---|---|---|---|
| 2,591,404 | 4/1952 | Carlson | 55/118 |
| 2,608,266 | 8/1952 | Wintermute | 55/129 |
| 2,615,529 | 10/1952 | Lincoln | 55/118 |
| 2,737,257 | 3/1956 | Warburton | 55/118 |
| 3,159,472 | 12/1964 | Revell | 55/118 |
| 3,785,118 | 1/1974 | Robertson | 55/13 X |
| 4,056,372 | 11/1977 | Hayashi | 55/152 |
| 4,342,571 | 8/1982 | Hayashi | 55/152 X |
| 4,381,927 | 5/1983 | Noll | 55/151 X |
| 4,481,017 | 11/1984 | Furlong | 55/130 X |

FOREIGN PATENT DOCUMENTS

| | | | |
|---|---|---|---|
| 518342 | 11/1955 | Canada | 55/118 |

*Primary Examiner*—Richard L. Chiesa
*Attorney, Agent, or Firm*—Mueller and Smith

[57] ABSTRACT

The improved traveling spray assembly and washing method includes a vertical header pipe mounted on tracks that run the length of the bank of collector plate electrodes. The header bears a plurality of nozzles directed to spray washing fluid onto the collector plate electrodes for their washing. A horizontal supply pipe is mounted along the top or the bottom of the electrostatic precipitator and extends to about the mid-point of the bank of collector plate electrodes. The horizontal supply pipe is connectable outside the electrostatic precipitator to a source of washing fluid. A pair of pivotally-connected pipes next are provided. One of the pipes is pivotally connected to the end of the supply pipe at the mid-point of the bank of collector plate electrodes and extends to a position opposite the supply pipe at either the bottom or top of the electrostatic precipitator. The other pipe extends back to the side of the supply pipe and is pivotally-connected to the header pipe. A vertical reflector plate is mounted on tracks that run the length of the bank of collector plate electrodes and disposed on the opposite side of the bank of collector plate electrodes in registration with the header pipe. A driver is connected to both the header pipe and to the reflector plate for simultaneous registered movement of the header pipe and the reflector pipe along the extent of the bank of collector plates.

14 Claims, 5 Drawing Sheets

FIG. 4
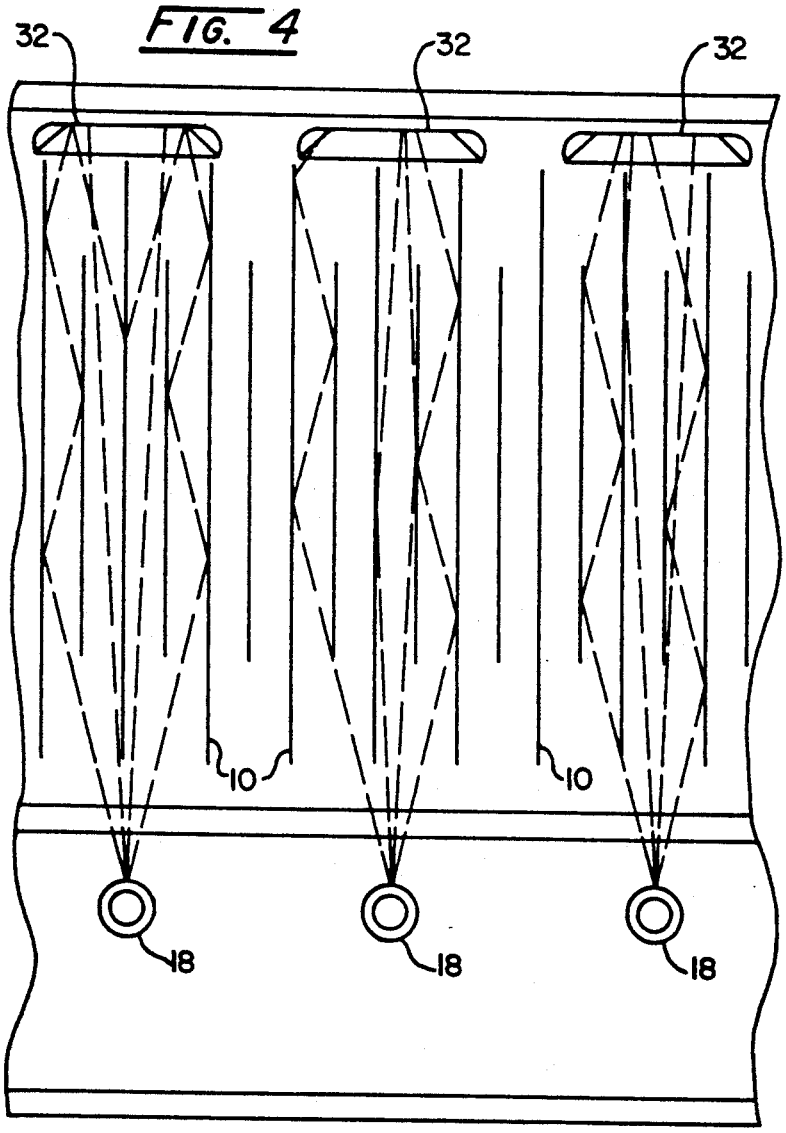
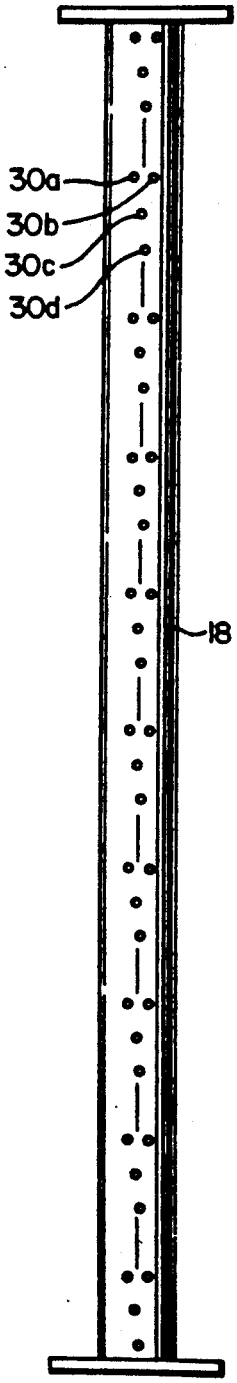
FIG. 5

7
58
50
7
18
8
52
8

42
46
44
38
46
56

62
58
60
48

54

68
64
66

FIG. 9
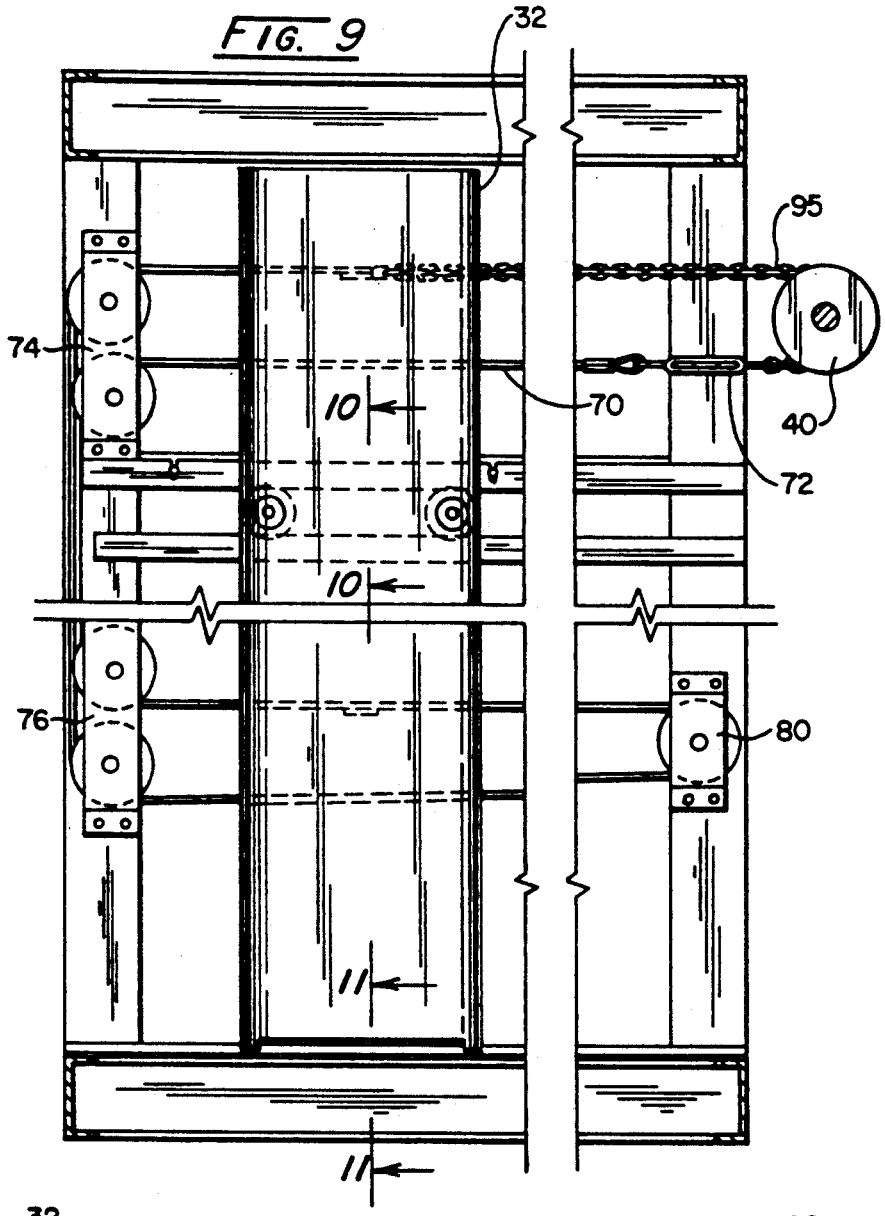
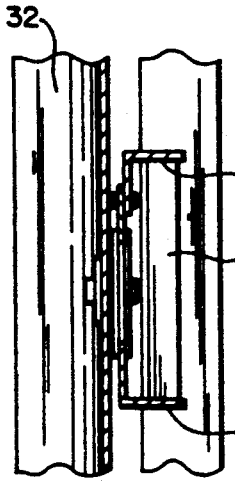
FIG. 10
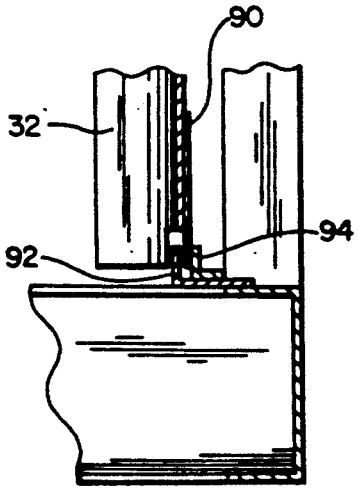
FIG. 11

TRAVELING SPRAY ASSEMBLY AND METHOD FOR WASHING OF ELECTROSTATIC PRECIPITATOR COLLECTOR PLATES

BACKGROUND OF THE INVENTION

The present invention generally relates to electrostatic precipitators that aid the efficient collection and elimination of dust and mist from industrial effluent gases, and more particularly to an improved traveling spray assembly for washing of the internal components of electrostatic precipitators.

The efficient collection and removal of the many and various dusts and mists that are found in industrial gases has been the goal of and is the basis for continued improvements in the electrostatic precipitator field. The conventional electrostatic precipitator for industrial particulate control has utilized an electrical corona generated between two electrodes for the electrical charging of dusts and mists that are suspended in the gaseous stream that is flowed between the electrodes. Such conventional electrostatic precipitators are known as "single-stage" electrostatic precipitators. Electrostatic precipitators in U.S. Pat. Nos. 4,056,372 and 4,381,927 are referred to in the field as parallel-plate, two-stage type electrostatic precipitators. Such electrostatic precipitators employ sets of plates that are divided further into two sub-sets of plates such that every other plate belongs to the same sub-set. Each sub-set is maintained at a different electrical potential by a direct current source. Additional developments in electrostatic precipitators of the parallel-plate type can be found in U.S. Pat. Nos. 4,381,927 and 4,342,571.

Another class of two-stage electrostatic precipitators are the grid-type which employ conventional ionizers in combination with perforated plate collectors. The construction of grid-type electrostatic precipitators calls for the perforated plates to be positioned perpendicular to the gaseous stream so the particles are deposited on the grids as the gas stream flows therethrough. Alternatively, a portion of the gases can be extracted through a permeable electrode to improve deposition as proposed in U.S. Pat. No. 4,481,017.

Regardless of the type of electrostatic precipitator and its mode of operation, the collector plate electrodes lose their efficiency for collection of additional particulate matter upon build-up of the particulate matter thereon. Accordingly, the electrostatic precipitator, or in most cases only the fouled field of collector plate electrodes, must be pulled off-line periodically for the collector plate electrodes to be cleansed of the collected particulate matter. The plate electrodes can be vibrated, subjected to sonic disruption, flushed with washing fluid, or subjected to additional techniques for removal of the collected particulate matter and re-establishment of the collector plate efficiency. Washing of collector plate electrodes can be accomplished by a stationary spray header pipe as shown in U.S. Pat. No. 2,608,266, or can take the form of a traveling vertical header mounted on a pair of tracks and connected to a flexible hose and which is moved by a drive cable along the extent of a bank of upstanding parallel, spaced-apart collector electrodes. Such traveling header spray systems have been marketed for several years commercially. Such systems are limited in the length of the bank of collector plates that can be washed by the length of the flexible hose connected to the vertical spray header pipe. Also, the washing fluid is sprayed from one end of the collector plates only which makes cleaning of the areas of the collector plate disposed opposite the spray header difficult. Thus, there is a need in the art for improved traveling spray assemblies adapted for washing of vertically-mounted, spaced-apart collector plate electrodes disposed in electrostatic precipitators.

BROAD STATEMENT OF THE INVENTION

Broadly, the present invention is directed to a traveling spray assembly adapted for use in an electrostatic precipitator for washing a bank of vertically-mounted, spaced-apart collector plate electrodes disposed therein. The improved traveling spray assembly comprises a vertical header pipe mounted on tracks that run the length of the bank of collector plate electrodes. The header bears a plurality of nozzles directed to spray washing fluid onto the collector plate electrodes for their washing. A horizontal supply pipe is mounted along the top or the bottom of the electrostatic precipitator and extends to about the mid-point of the bank of collector plate electrodes. The horizontal supply pipe is connectable outside the electrostatic precipitator to a source of washing fluid. A pair of pivotally-connected pipes next are provided. One of the pipes is pivotally connected to the end of the supply pipe at the mid-point of the bank of collector plate electrodes and extends to a position opposite the supply pipe at either the bottom or top of the electrostatic precipitator. The other pipe extends back to the side of the supply pipe and is pivotally-connected to the header pipe. A vertical reflector plate is mounted on tracks that run the length of the bank of collector plate electrodes and disposed on the opposite side of the bank of collector plate electrodes in registration with the header pipe. Such arrangement means that washing fluids sprayed by the header pipe into the collector plate electrodes can be reflected back onto the collector plate electrodes for additional washing of the areas of the collector plates disposed away from the header pipe. A driver is connected to both the header pipe and to the reflector plate for simultaneous registered movement of the header pipe and the reflector pipe along the extent of the bank of collector plates.

Advantages of the present invention include the ability to more efficiently and effectively wash collector plates by use of the reflector plate. Another advantage is the ability of the header pipe to travel the full extent of the bank of collector plate electrodes by use of the pivotally-connected, scissored pipe arrangement that supplies washing fluid to the header pipe. Another advantage is a traveling spray assembly that is simple in construction and easy to operate and maintain. These and other advantages will become readily apparent to those skilled in the art based upon the disclosure contained herein.

BRIEF DESCRIPTION OF THE DRAWINGS

FIG. 4 is a simplified overhead plan view showing the header pipe spraying washing fluid onto parallel collector plate electrodes at three different positions within the electrostatic precipitator;

FIG. 5 is an enlarged elevational view of the vertical header pipe bearing a plurality of nozzles for directing spray washing fluid onto the bank of collector plate electrodes;

FIG. 9 is a side elevational view showing the drive assembly connected to the vertical reflector plate broken away to show both ends of the electrostatic precipitator;

FIG. 10 is a sectional view taken along line 10—10 of FIG. 9; and

FIG. 11 is a sectional view taken along line 11—11 of FIG. 9.

The drawings will be described in detail in connection with the description of the invention below.

DETAILED DESCRIPTION OF THE PREFERRED EMBODIMENT

Figure 1:
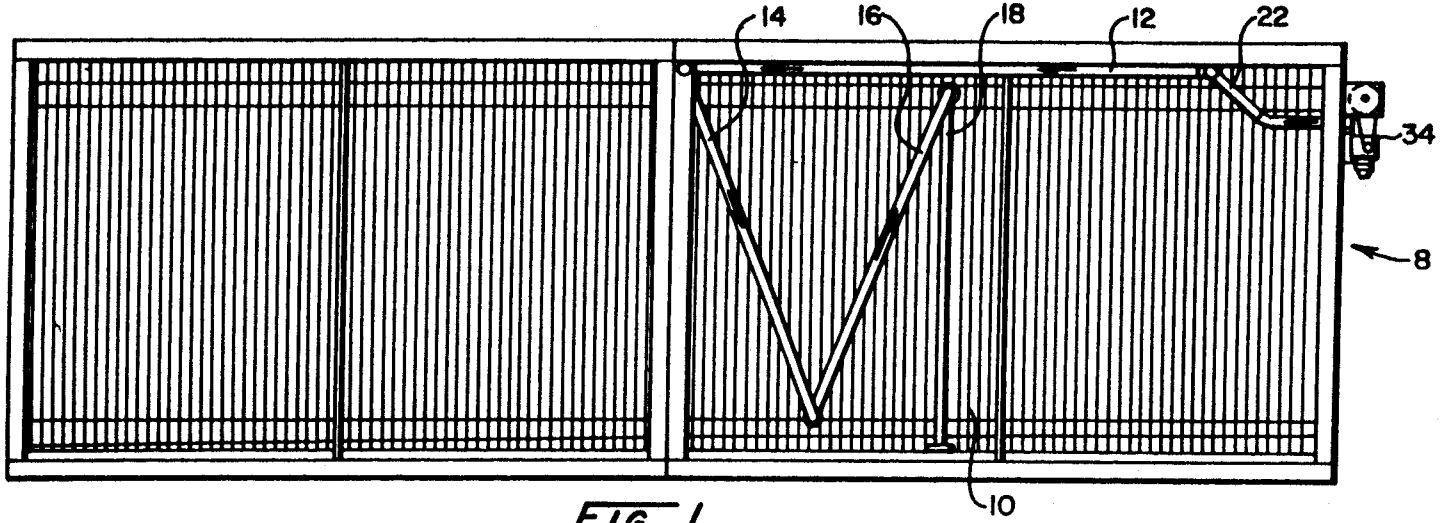
FIG. 1 is a cut-away elevational view of an electrostatic precipitator housing a bank of vertically-mounted, spaced-apart collector plate electrodes and the inventive traveling spray assembly for washing of them.
Figure 2:
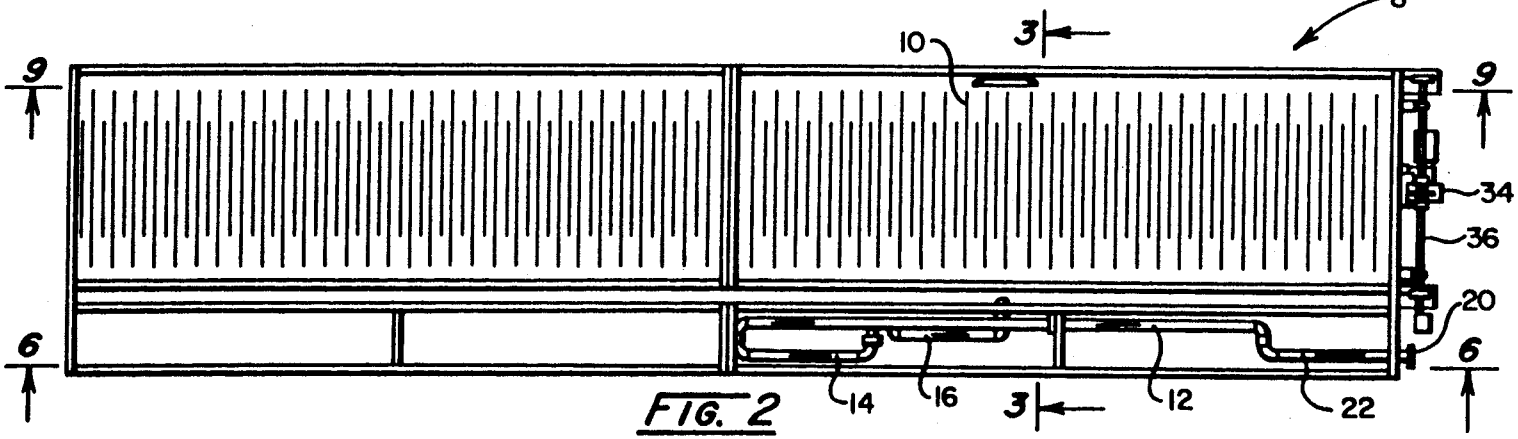
FIG. 2 is an overhead plan view of the electrostatic precipitator depicted at FIG. 1.

The construction details of electrostatic precipitator 8 depicted at FIGS. 1 and 2 will not be described in detail as such units are well known in the art. For purposes of illustration, a two-stage electrostatic precipitator of the parallel-plate type is illustrated in the drawings. The bank of parallel plates is typified by plate 10 which is revealed at FIG. 3 to be a perforated or apertured collector plate electrode. The particular construction details and type of electrostatic precipitator are unimportant to the invention and is to be provided in conventional fashion, such as is disclosed in the art cited above.

The primary components of the traveling spray assembly of the present invention include header pipe 12, supply pipes 14 and 16, and vertical spray pipe 18. Header pipe 12 is connected to inlet 20 (FIG. 2) by arcuate pipe segment 22. Inlet 20 is connectable to a source of washing fluid which is used to wash collector plate electrode 10 and the other collector plate electrodes for their cleaning.

Figure 3:
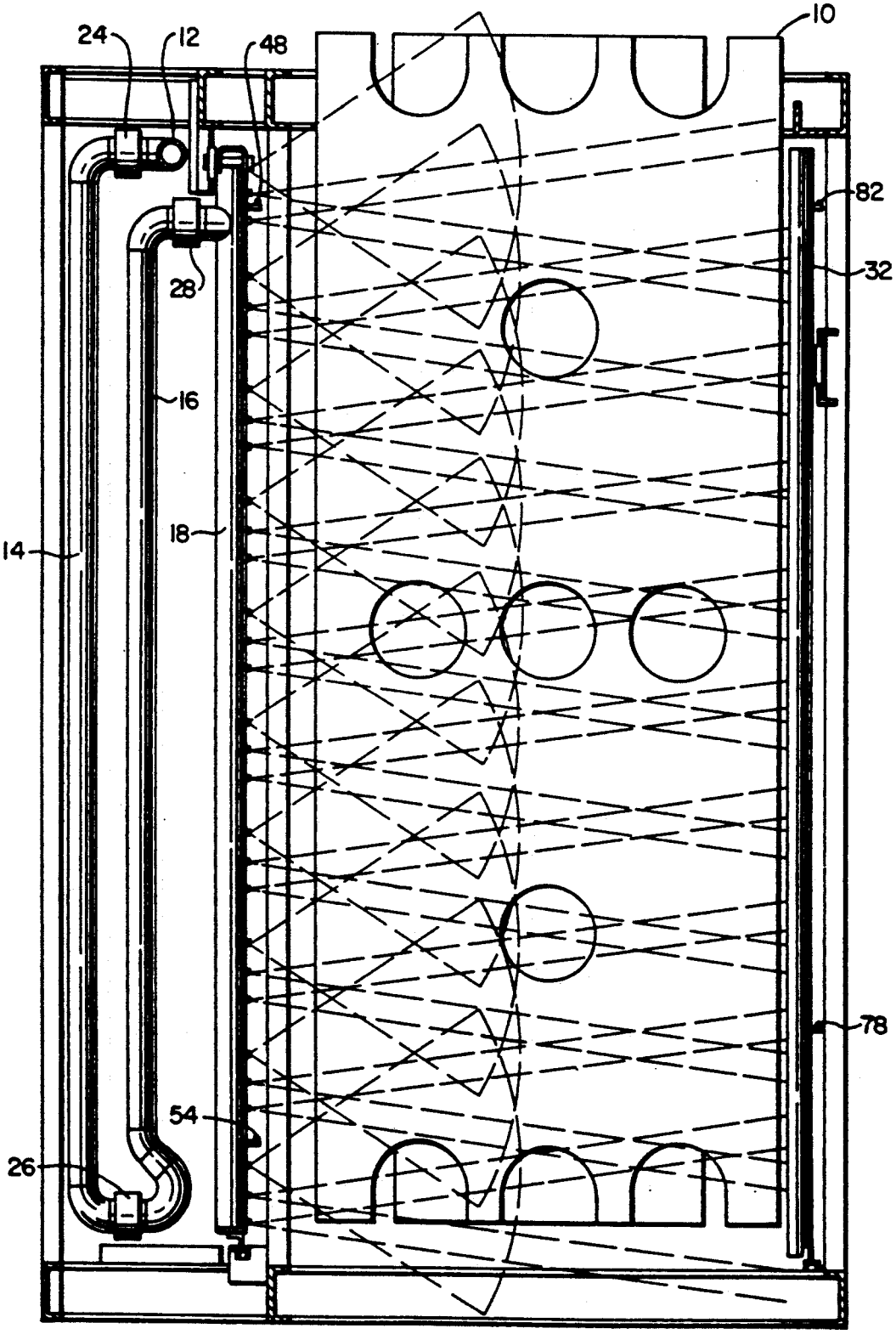
FIG. 3 is a sectional view taken along line 3—3 of FIG. 2.

With respect to FIG. 1-3, it will be observed that header pipe 12 is pivotally connected to supply pipe 14 by swivel joint 24. Supply pipes 14 and 16, in turn, are pivotally connected by swivel joint 26. Finally, supply pipe 16 is pivotally connected to vertical spray pipe 16 by swivel joint 28. It will be appreciated that, by lateral movement of spray pipe 18 along the extent of the bank of collector plate electrodes, supply pipes 14 and 16 exhibit a scissors action permitting spray pipe 18 to traverse from one end of precipitator 8 to the other end of precipitator 8. In this regard, such full range of movement is permitted by virtue of the swivel joint connections wherein header pipe 12 terminates at about the mid-point of precipitator 8 whereat supply pipe 14 is connected thereto. Also in this regard, it will be appreciated that pipes 12-18, inclusive, need not be flexible in order for spray pipe 18 to traverse the extent of electrostatic precipitator 8. In fact, due to corrosion and erosion considerations, pipes 12-18, outlet 20, and pipe 22 all are made from corrosion-resistant materials which preferably comprise stainless steel or other alloy. Such pipes, accordingly, are rigid for durability and longevity of the traveling spray assembly of the present invention.

Referring to FIGS. 3-5, it will be appreciated that vertical spray pipe 18 is seen to bear a plurality of nozzles in a preconfigured pattern, typified by nozzles 30*a-d* which form a pattern that is repeated a multitude of times along the vertical extent of spray pipe 18. The configuration of the pattern and number of repeats of the pattern of spray nozzles is not critical and is left to the judgment of the engineer designing the traveling spray assembly of the present invention. In the spray assembly shown in the drawings, a combination of 15° and 65° angle flat spray nozzles, of brass construction, are utilized in order to provide a spray pattern calculated to maximize contact with the entire surface area of collector plate electrode 10. The spray pattern can be seen by reference to FIGS. 3 and 4.

With respect to the spray patterns formed, reference is made to FIGS. 4 and 9 which depict vertical reflector plate 32 which is disposed oppositely to and in registration with vertical spray pipe 18, though at the opposite edges of the parallel collector plate electrodes. Reflector plate 32 reflects the spray pattern of washing fluid striking it back onto the side surface areas of the collector plate electrodes for enhancing the washing action, especially at areas of the collector plate electrodes on the far side from vertical spray pipe 18. FIG. 4, in particular, shows vertical spray pipe 18 in three different positions along with reflector plate 32 in registration therewith and the multiplicity of reflector patterns that are possible from the alignment of spray nozzles which are borne by vertical spray pipe 18.

With respect to simultaneous, registered movement of spray pipe 18 and reflector plate 32, it will be observed at FIGS. 1 and 2 that precipitator 8 retains gear reduction motor 34 which provides simultaneous registered movement of spray pipe 18 and reflector plate 32 through drive shaft 36 which is connected to chain sheave 38 (FIG. 6) and chain sheave 40 (FIG. 9).

Figure 6:
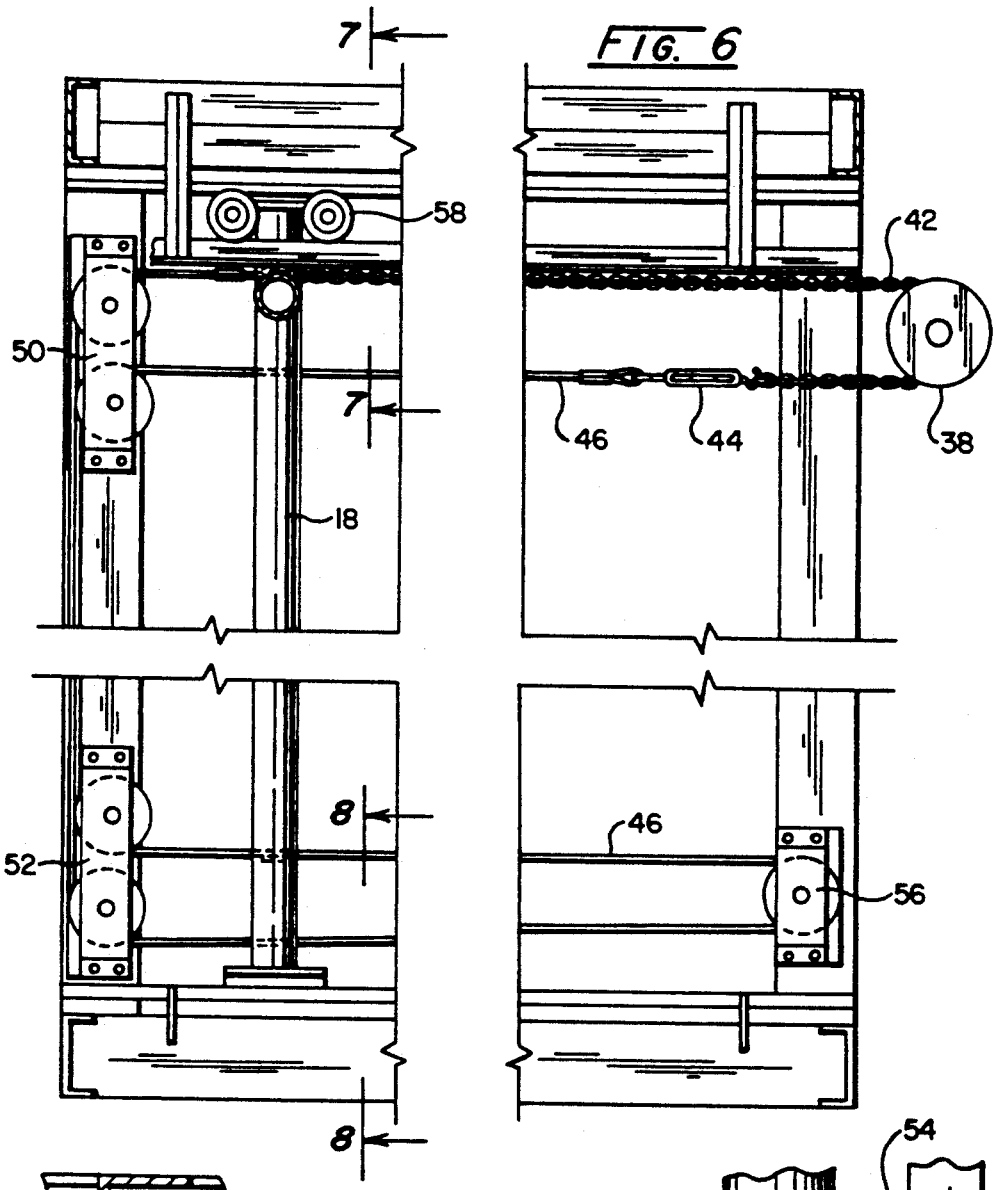
FIG. 6 is an enlarged side elevational view broken away to show the drive assembly for the vertical header pipe at both ends of the electrostatic precipitator.
Figure 7:
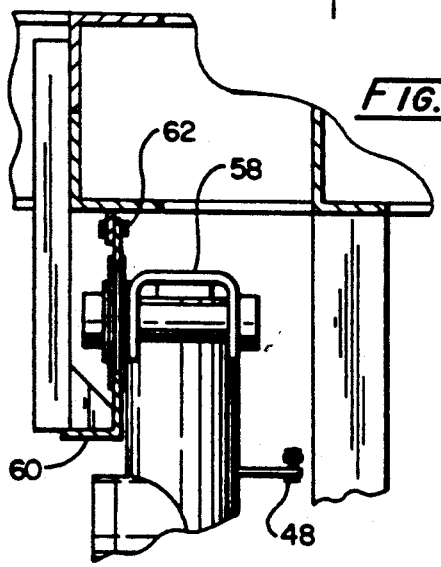
FIG. 7 is a sectional view taken along line 7—7 of FIG. 6.
Figure 8:
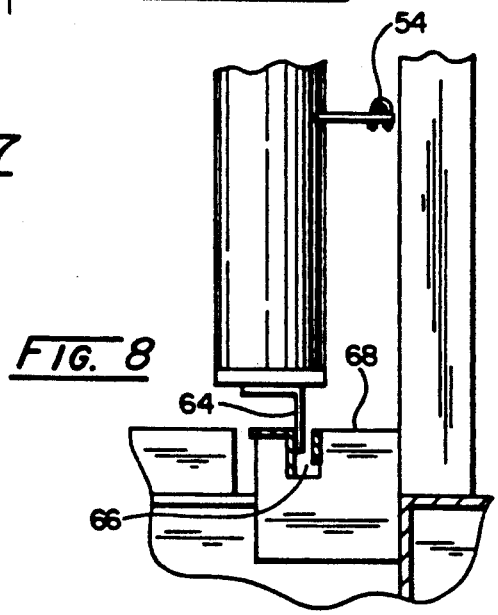
FIG. 8 is an elevational view taken along line 8—8 of FIG. 6.

With respect to the drive assembly for vertical spray pipe 18, reference is made to FIGS. 6-8. Chain sheave 38 is seen to retain chain 42 thereabout which is connected via turnbuckle 44 to one end of cable 46. The opposite ends of chain 42 and cable 46 are connected to spray pipe 18 by retainer 48 (FIG. 3). Again, all materials of construction are of corrosion-resistant materials which preferably comprise stainless steel alloys.

Cable 46 from turnbuckle 44 runs the extent of precipitator 8 to the lower pulley of pulley bracket assembly 50 and thence vertically to the upper pulley of pulley bracket assembly 52. From there, cable 46 then runs through U bracket 54 of spray pipe 18 for its connection thereto and thence to the pulley of pulley bracket assembly 56. From there, cable 46 proceeds to the lower pulley of pulley bracket assembly 52, vertically upward to the upper pulley of pulley bracket assembly 50, and thence to its connection to spray pipe 18 by connector 48. Thus, cable 46 is connected at two different locations to vertical spray pipe 18 for its movement.

Referring to FIGS. 7 and 8, it will be observed that located about the upper end of spray pipe 18 is trolley 58 which is retained by the track formed from angle iron 60 and plate 62. The lower end of spray pipe 18 contains angle iron 64 which rides in trough 66 formed in structural member 68 of precipitator 8. Thus, as gear reduction motor 34 rotates, drive shaft 36 causes chain sheave 38 to rotate which, in turn, moves vertical spray pipe 18 laterally the length of precipitator 8. Spray pipe 18 is maintained in position by trolley 58 and angle iron 64 with two points of connection of cable 46 to it providing smooth movement of spray pipe 18.

Referring to FIGS. 9–11, drive shaft 36 also is connected to pulley 40 which retains chain 95 which has one end connected to cable 70 by turnbuckle 72. The opposite ends of cable 70 and chain 95 are connected to reflector plate 32 by retainer 82. Cable 70 proceeds from turnbuckle 72 to the lower pulley of pulley bracket assembly 74 and thence vertically downwardly to the upper pulley of pulley bracket assembly 76. From there, cable 70 is connected to reflector plate 32 by connector 78. The cable then proceeds to the pulley of pulley bracket assembly 80 and thence back to the lower pulley of pulley bracket assembly 76. From there, cable 70 proceeds vertically upwardly to the upper pulley of pulley bracket assembly 74 to its connection to reflector plate 32 by connector 82 and chain 95 returns to pulley 40.

Referring to FIGS. 10 and 11, it will be observed that reflector plate 32 retains trolley 84 which rides in the track formed by adjustable angle iron 86 and lower angle iron 88. Two wheels provide stability for trolley 84. The lower edge of reflector plate 32 bears plate 90 which rides in the recess created by angle irons 92 and 94 that are affixed to the superstructure of precipitator 8. Thus, rotation of pulley 40 by drive shaft 36 causes reflector plate 32 to traverse the entire extent of precipitator 8. Since both chain sheave 38 and pulley 40 are driven by the same drive shaft, their movement will be simultaneous. Since spray pipe 18 is initially installed directly opposite reflector plate 32, their movement also will be in registration for achieving the reflected spray patterns as depicted in FIG. 4.

Since certain changes may be made in the above invention without departing from the scope of the invention disclosed herein, it is intended that all matter contained in the above description or shown in the accompanying drawings shall be interpreted as illustrative and not in a limiting sense. All citations disclosed herein are expressly incorporated herein by reference.

I claim:

1. In a traveling spray assembly mounted in an electrostatic precipitator for washing of a bank of vertically-mounted, spaced-apart collector plate electrodes disposed therein, the improvement which comprises:

(a) a vertical spray pipe mounted on tracks that run the length of said bank of collector plate electrodes, said spray pipe bearing a plurality of nozzles directed to spray washing fluid onto said collector plate electrodes for their washing;

(b) a horizontal header pipe mounted along the top or bottom of said electrostatic precipitator and extending to about the midpoint of said bank of collector plate electrodes in said electrostatic precipitator, said header pipe connectable outside said electrostatic precipitator to a source of washing fluid;

(c) a pair of pivotally-connected supply pipes, one of which is pivotally connected to the end of said header pipe at the midpoint of said bank of collector plate electrodes and extends to the side opposite said header pipe, the other of which extends back to the side of the header pipe and is pivotally-connected to said spray pipe;

(d) a vertical reflector plate mounted on tracks that run the length of said bank of collector plate electrodes, said reflector plate disposed on the opposite side of said bank of collector plate electrodes in registration with said spray pipe, whereby washing fluid spayed by said spray pipe onto said collector plate electrodes can be reflected back onto said collector plate electrodes; and (e) a drive assembly connected to said spray pipe and to said reflector plate for simultaneous registrated movement of said spray pipe and said reflector plate along the extent of said bank of collector plates.

2. The traveling spray assembly of claim 1 wherein said horizontal header pipe is mounted along the top of said electrostatic precipitator.

3. The traveling spray assembly of claim 1 wherein said drive assembly comprises a motor connected to a drive shaft which is connected to a pair of cable and pulley assemblies, one each of which is connected to said vertical spray pipe and to said vertical reflector plate, whereby rotation of said drive shaft results in simultaneous registered movement of said vertical spray pipe and said vertical reflector plate.

4. The traveling spray assembly of claim 3 wherein said pulley assemblies include an upper and a lower pulley assembly connected at the end of said electrostatic precipitator being oppositely-disposed from the end where said drive assembly is located.

5. The traveling spray assembly of claim 1 wherein said vertical spray pipe is mounted on an upper track by a pair of rotating wheels located about the top of said vertical spray pipe and in the recess of a lower track by an angle iron affixed thereto.

6. The traveling spray assembly of claim 1 wherein said vertical reflector plate is mounted on an upper track by a pair of rotating wheels located about the center of said vertical reflector plate and in the recess of a lower track by a plate affixed thereto.

7. The traveling spray assembly of claim 1 constructed from a stainless steel alloy.

8. A method for washing a bank of vertically-mounted, spaced-apart collector plate electrodes disposed in an electrostatic precipitator, which comprises the steps of:

(A) providing a traveling spray assembly which comprises:

(a) a vertical spray pipe mounted on tracks that run the length of said bank of collector plate electrodes, said spray pipe bearing a plurality of nozzles directed to spray washing fluid onto said collector plate electrodes for their washing;

(b) a horizontal header pipe mounted along the top or bottom of said electrostatic precipitator and extending to about the midpoint of said bank of collector plate electrodes in said electrostatic precipitator, said header pipe connected outside said electrostatic precipitator to a source of washing fluid;

(c) a pair of pivotally-connected supply pipes, one of which is pivotally connected to the end of said header pipe at the midpoint of said bank of collector plate electrodes and extends to the side opposite said header pipe, the other of which extends back to the side of the header pipe and is pivotally-connected to said spray pipe;

(d) a vertical reflector plate mounted on tracks that run the length of said bank of collector plate electrodes, said reflector plate disposed on the opposite side of said bank of collector plate electrodes in registration with said spray pipe, whereby washing fluid spayed by said spray pipe onto said collector plate electrodes can be reflected back onto said collector plate electrodes; and (e) a drive assembly connected to said spray pipe and to said reflector plate for simultaneous registrated movement of said spray pipe and said reflector plate along the extent of said bank of collector plates; and (B) moving said vertical spray pipe and said vertical reflector plate with said drive assembly while causing said washing fluid to be sprayed from said nozzles directed onto said collector plate electrodes for their washing.

9. The method of claim 8 wherein said horizontal header pipe is mounted along the top of said electrostatic precipitator.

10. The method of claim 8 wherein said drive assembly comprises a motor connected to a drive shaft which is connected to a pair of cable and pulley assemblies, one each of which is connected to said vertical spray pipe and to said vertical reflector plate, whereby rotation of said drive shaft results in simultaneous registered movement of said vertical spray pipe and said vertical reflector plate.

11. The method of claim 10 wherein said pulley assemblies include an upper and a lower pulley assembly connected at the end of said electrostatic precipitator being oppositely-disposed from the end where said drive assembly is located.

12. The method of claim 8 wherein said vertical spray pipe is mounted on an upper track by a pair of rotating wheels located about the top of said vertical spray pipe and in the recess of a lower track by an angle iron affixed thereto.

13. The method of claim 8 wherein said vertical reflector plate is mounted on an upper track by a pair of rotating wheels located about the center of said vertical reflector plate and in the recess of a lower track by a plate affixed thereto.

14. The method of claim 8 wherein said traveling spray assembly is constructed from a stainless steel alloy.

* * * * *